United States Patent [19]

Janik

[11] 4,201,334

[45] May 6, 1980

[54] SIGNAL AND RECEPTACLE COMBINATION

[76] Inventor: John W. Janik, 40 S. Tyler St., Beverly Hills, Lecanto, Fla. 32661

[21] Appl. No.: 941,684

[22] Filed: Sep. 12, 1978

[51] Int. Cl.[2] ..... A47G 29/12

[52] U.S. Cl. ..... 232/34

[58] Field of Search ..... 297/17, 1 C, 34

[56] References Cited

U.S. PATENT DOCUMENTS

| | | | |
|---|---|---|---|
| 889,727 | 6/1908 | Siegfried | 232/34 |
| 2,927,726 | 3/1960 | Workman | 232/34 |

*Primary Examiner*—Francis K. Zugel

*Attorney, Agent, or Firm*—Stein & Frijouf

[57] ABSTRACT

A signal device for a mailbox or similar roadside receptacle has an abutment member received in the box on its bottom wall in position to be engaged by mail, or some other article, and thereby moved to the opposite end of the box. The abutment member is secured to a rigid rod extending through the rear of the mailbox and carrying a signal flag outside the box. This rod is inclined to the bottom wall of the box so that as the abutment member is engaged by the mail or other article, the signal flag is moved laterally of the mailbox so that it may be more clearly seen from a distance than when it is possibly concealed by the perimiter of the mailbox when closely proximate the adjacent end of the mailbox.

2 Claims, 4 Drawing Figures

SIGNAL AND RECEPTACLE COMBINATION

This invention pertains to a signal device in combination with a receptacle, such as a mailbox, and to a method for signalling whether or not the receptacle has received an article, such as mail, and, more particularly to such a combination and method in which a signal is moved laterally of the receptacle when an article is received thereby, so that the signal may be more clearly seen.

BACKGROUND OF THE INVENTION

Most roadside mailboxes and other receptacles such as for newspapers, or the like, are normally positioned with the rear of the mailbox facing the house or other building from which it is normally observed. Thus, a signal flag, or the like, placed at the rear of the mailbox generally has its position somewhat obscured by rear of the box, particularly if the signal remains within the perimiter of the box as it changes position when the box receives mail or some other article, as in the following patents: U.S. Pat. No. 889,727, and U.S. Pat. No. 2,927,726. Both of these patents have a signal which is obscured from the rear of the box by the perimeter of the box. In the first patent the signal is a knob "a" shown on a rod "6" with an abutment plate "6*a*" on an opposite end of the rod and within the box, so that the signal knob is at the same general position as viewed from the rear, whether or not the knob is extended from or withdrawn toward the box. The other patent is much newer, but is otherwise similar to the first noted patent, but adds a lower signal flag "52" which depends through a slot "16" in the bottom of the receptacle. This lower signal would require provision of a slot in the bottom of the box, and therefore would not be practical for installation on pre-existing boxes. In U.S. Pat. No. 2,496,962, the objection of the signal being obscured from the rear of the box by the perimiter of the box is generally overcome, but is not suitable for use on pre-existing boxes because, again, a slot must first be provided in the bottom of the box, and a pair of ears "27" would have to be secured to the box adjacent the ends of the slot.

Other patents, which are primarily concerned with operaters or retainers for the convention flag signal on a mailbox, include: U.S. Pat. Nos. 1,316,837; 1,927,736; 3,166,241; 3,392,911; and 3,623,655. While these five patents are known to applicant, they are not felt to be partcularly pertinent to the present invention.

BRIEF DESCRIPTION OF THE INVENTION

The invention, in brief, is concerned with providing a signal for a receptacle, such as a typical mailbox, for example, to automatically indicate whether or not an article, such as mail, for example, has been deposited in the box. The signal is part of a signal device which may be provided with the box, or may be installed on pre-existing boxes. A rod extends within the box from an end secured to an abutment member normally at the article receiving end of the box, and through an opposite end of the box to an end secured to the signal. The box is normally horizontally disposed with its opposite ends horizontally spaced apart. The abutment member is supported on the bottom wall of the box and the rod moves the signal from general alignment with the rear end of the box to a position spaced laterally of the box as the abutment member is moved by the article toward the rear end of the box.

It is an object of the invention to provide a new and useful signal for indicating whether or not a receptacle has received an article.

Another object is to provide a new and useful combination of a signal device and a receptacle, for indicating when the receptacle has received an article. More particularly, still another object is provision of such a combination in which the signal device automatically indicates whether or not the article has been placed in the receptacle. The receptacle has first and second opposite ends with the first end being adapted for insertion of the article into the receptacle. The signal device including an abutment member positioned within the receptacle generally proximate the first end thereof for movement between the ends of the receptacle. A signal member is generally proximate the second end of the receptacle, and secured to one end of a rigid member with the opposite end secured to the abutment member. The rigid member extends freely through an opening in a support member at the second end of the receptacle, with provision for mounting the rigid member to move outwardly of the second end of the receptacle as the abutment member moves from the first end toward the second end of the receptacle. A related object is provision of the abutment member as a plate-like member supported on a bottom portion of the receptacle and the first and second ends thereof being generally horizontally spaced from each other. The rigid member is preferably a rod-like member fixedly secured to the plate-like member with the signal member being releasably secured to the rod-like member for easy installation of the signal device with the receptacle.

These and other objects and advantages of the invention will become apparent from the following description and drawing.

DESCRIPTION OF THE ILLUSTRATED EMBODIMENT

Figure 1:
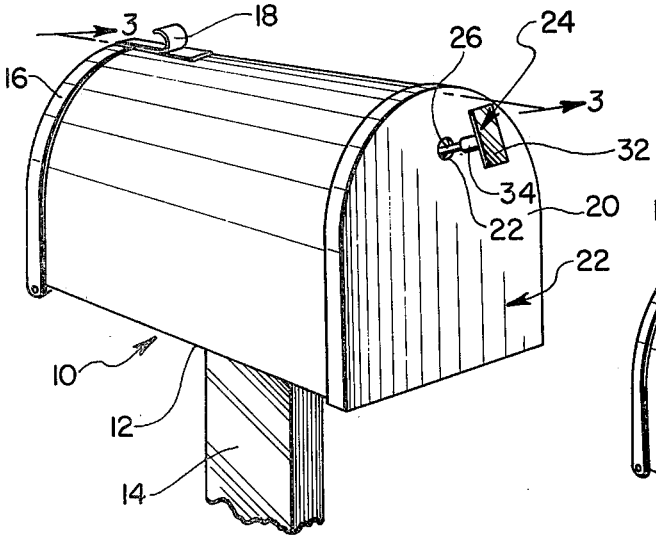
FIG. 1 is a schematic, fragmentary perspective view of a preferred form of the invention with a signal of a signal device withdrawn toward the rear wall of of a mailbox, and within the perimiter of the rear wall, and with the usual postman's signal flag not shown for clearer illustration of the invention.

Referring to the drawing a receptacle illustrated in the form a a typical roadside mailbox 10 is shown with its bottom wall 12 typically horizontal and secured to a supporting post 14. The mailbox 10 has a first, front end with a typical hinged lid 16 carrying a keeper 18 at its top. A second or rear end of the mailbox is permanently closed by a rear wall 20, in typical manner. Rear wall 20 has an aperture 22 which receives a signal device 24.

Signal device 24 includes a rigid rod 26 extending through the aperture 24 with a fore part of the rod 26 fixedly secured, as by welding, for example, to an abutment member illustrated in the form of a plate 28. Four braces 30 fixedly secure the rod 26 to each of four corners of the abutment plate 28. A signal 32, illustrated in the form of a generally flat plate 34 generally parallel to the rear wall 20 of the mailbox is preferably releasably secured to an adjacent end of the rigid rod 26, for example by an internally threaded boss 36 threaded on the end of the rod 26.

Figure 2:
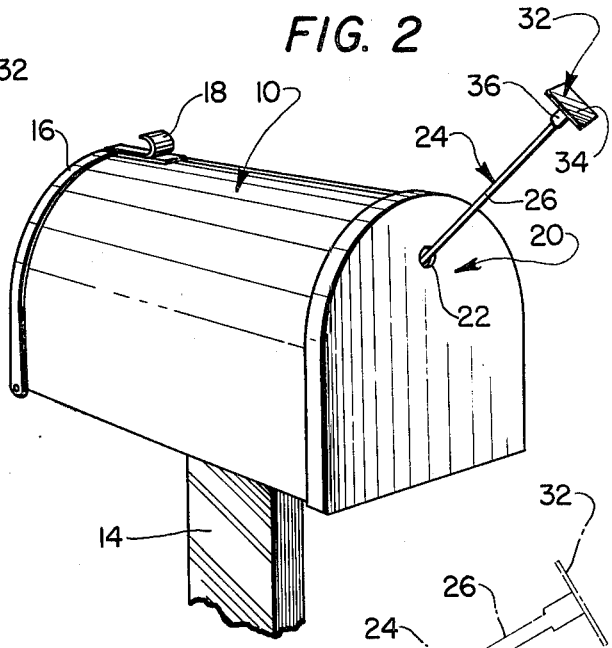
FIG. 2 is a view similar to FIG. 1, but with the signal extended from the rear wall and above the box indicating the mail has been deposited in the box.
Figure 3:
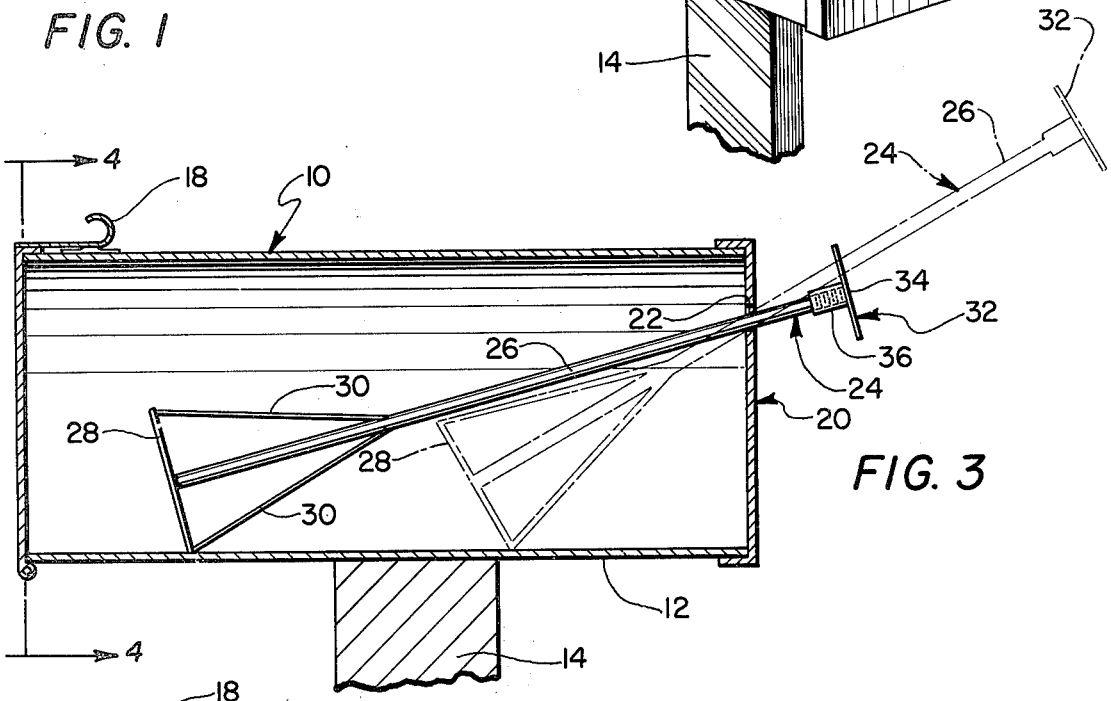
FIG. 3 is a schematic, enlarged sectional elevational view taken generally along the line 3—3 in FIG. 1, and with the signal device shown in the position of FIG. 2 by means of phantom lines.
Figure 4:
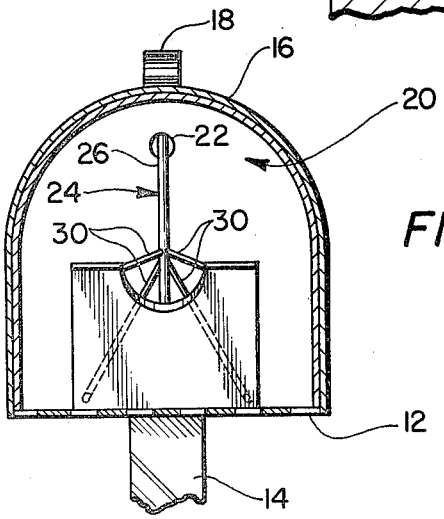
FIG. 4 is a schematic, sectional elevational view taken generally along the line 4—4 in FIG. 3.

As may be noted from the drawing, the rod 26 is inclined to the bottom wall 12 of the mailbox 10, and the abutment plate 28 is supported on the bottom wall 12. When the signal device 24 is fully retracted into the mailbox 10, as may best be seen in FIGS. 1 and 3, the signal plate 34 is closely proximate the rear wall 20 of the mailbox 10 and is within the perimeter of the rear wall. However, when an article, such as mail, is deposited in the box 10 and engages the abutment plate 28, the inclined rod 26 is moved rearwardly through the aperture 22 in the rear wall 20. Accordingly, the signal 32 is moved rearwardly and upwardly of the perimeter of the rear wall 20, as may best be seen FIG. 2 and by the phantom lines in FIG. 3, so that the signal plate 34 is more clearly visible from behind the mailbox 10.

The invention is equally applicable to any similar receptacle for receiving an article, for example to the typical roadside newspaper box, and is therefore not to be limited to the illustrated embodiment, or the the discussed environment, except as set forth in the appended claims.

What is claimed is:

1. In combination of a receptacle and a signal device for automatically indicating the presence of an article within the receptacle, comprising in combination:

a bottom, top and side walls defining an inner volume of the receptacle;

a first end of the receptacle being adapted for inserting the article into the receptacle;

an end wall secured to the second end of the receptacle;

an aperture disposed in said end wall of the receptacle and located approximate the upper portion of the end wall;

a signalling member comprising a plate-like abutment member supported on the bottom of the receptacle;

a substantially rigid rod having a first end secured to said abutment member and extending through said aperture in said end wall of the receptacle;

an indicator disposed on a second end of said rod for movement in accordance with the abutment member;

means establishing the length of said rod and the position of said aperture in said end wall of said receptacle enabling said indicator to be disposed below the top of said receptacle when the abutment member is moved in the extreme position toward the first end of the receptacle indicating the absence of the article within the receptacle; and said indicator being disposed above the top of the said receptacle upon movement of the abutment member from the first end toward the second end of the receptacle in response to the movement of the abutment member by the depositing of an article within the receptacle.

2. An apparatus as set forth in claim 1 including means for removably mounting said indicator to said second end of said rod enabling said rod to be passed through an aperture in the receptacle prior to securing of said indicator to said rod enabling said indicator to be positioned upon an existing receptacle.

* * * * *